US007214102B2

(12) United States Patent
Chong

(10) Patent No.: US 7,214,102 B2
(45) Date of Patent: May 8, 2007

(54) SOCKET WITH ROTATABLE SOCKET CORE

(76) Inventor: Shui Hung Chong, RM 806, 8/F, Shing Fung Hse, Kwai Shing Est, Kwai Chung, NT, Hong Kong (HK)

( * ) Notice: Subject to any disclaimer, the term of this patent is extended or adjusted under 35 U.S.C. 154(b) by 0 days.

(21) Appl. No.: 10/545,682

(22) PCT Filed: Apr. 5, 2005

(86) PCT No.: PCT/CN2005/000444

§ 371 (c)(1),
(2), (4) Date: Aug. 15, 2005

(87) PCT Pub. No.: WO2006/032179

PCT Pub. Date: Mar. 30, 2006

(65) Prior Publication Data

US 2006/0281349 A1 Dec. 14, 2006

(30) Foreign Application Priority Data

Sep. 20, 2004 (CN) ..... 2004 2 0088558 U
Feb. 1, 2005 (CN) ..... 2005 1 0033151

(51) Int. Cl.
*H01R 31/00* (2006.01)

(52) U.S. Cl. ..... 439/652; 439/640; 439/173

(58) Field of Classification Search ..... 439/173, 439/640, 131, 652, 13
See application file for complete search history.

(56) References Cited

U.S. PATENT DOCUMENTS 6,302,743 B1 * 10/2001 Chiu et al. ..... 439/652
6,332,794 B1 * 12/2001 Tzeng Jeng ..... 439/188
6,638,074 B1 * 10/2003 Fisher ..... 439/22

* cited by examiner

*Primary Examiner*—Tho D. Ta

(57) ABSTRACT

The present invention relates to an electrical socket with rotatable socket core. It comprises a cover having at least one opening; a base plate; an electrode bracket having at least one opening which is disposed in between the cover and the base plate; and at least one socket core that is rotatable in one full circle which passes through the opening of the cover and is disposed inside the openings of the electrode bracket, wherein a plurality of apertures is disposed longitudinally inside the socket core. While inserting, if there is insufficient space, the space limitation can be overcome by rotating and changing the angle of the socket core appropriately and the plug can be successfully inserted into the socket.

8 Claims, 14 Drawing Sheets

SOCKET WITH ROTATABLE SOCKET CORE

BACKGROUND OF THE INVENTION

The present invention relates to an electrical socket and more particularly pertains to an electrical socket with a flexible rotatable position for plug insertion and which is convenient for use within a small narrow space.

With the continuous developments of science and technology, electricity becomes an indispensable part of people's live and work. A variety of electrical sockets for industrial or domestic use have been developed for convenient use of electricity, thereby increasing production efficiency and living quality. However, when an electrical socket is used, if the space surrounding the socket is small and narrow, incidents of having insufficient space for plug insertion will commonly arise. This causes enormous inconvenience to people's live and work.

The inventor of the present invention disclosed a rotatable socket in a Chinese patent application (Application No.: 200420072276.2). The major construction of the socket is that a plurality of rotatable electrically conductive contact blades parallel to one another is disposed in layers inside the socket core. The rotatable electrically conductive contact blades are provided with apertures which correspond to pins of a plug for their insertion. The outer edges of the rotatable electrically conductive contact blades are connected in a sliding manner to connecting spring pieces which are fixed to the inside of the housing of the socket. The fixed connecting spring pieces can be connected to the electricity source conducting wires. When pins of a plug are inserted correspondingly into the apertures of the rotatable electrically conductive contact blades inside the socket, by rotating the plug the rotatable electrically conductive contact blades can be actuated to rotate in relation to the fixed connecting spring pieces, thereby attaining the rotation of the socket core. Although such construction attains the effect of rotating the plug, it is complicated in structure. It requires a high level of processing precision for parts. Assembling is also difficult. The pins and the apertures of the contact blades are vulnerable to wear. The life span and the safety performance of the socket are affected adversely.

BRIEF SUMMARY OF THE INVENTION

It is an object of the present invention to provide a socket with rotatable socket core which is safe and reliable and susceptible of low manufacturing costs, thereby overcoming the technical problems of the existing electrical sockets of being complicated in structure, involving high manufacturing costs, and having short life span and low safety performance.

To attain this, the present invention generally comprising a cover having at least one opening;

a base plate;

an insulated electrode bracket having at least one opening which is disposed in between the cover and the base plate, wherein the inner circumferential surfaces of the openings of the electrode bracket are provided with electrically conductive members positioned separately and longitudinally, and the electrically conductive members are connected to electricity supply members which can be electrically connected to an outside electricity source;

at least one socket core that is rotatable in one full circle which passes through the opening of the cover and is disposed inside the openings of the electrode bracket, wherein a plurality of apertures is disposed longitudinally inside the socket core, and a plurality of electrically conductive springs is provided inside each of the apertures, and a side portion of each of the electrically conductive springs diverges longitudinally and protrudes outwards from the outer circumferential surface of the socket core, and maintains contacts with one of the electrically conductive members correspondingly.

The electrode bracket is integrally formed or assembled into one piece or is divided into layers and stacked together to form one piece.

The electrically conductive members of the present invention can be electrically conductive rings disposed on the inner surfaces of the openings of the electrode bracket.

The socket core can comprise a core pillar with ascending steps on its outer circumferential surface, a base cover with descending steps on its outer circumference which engage with the ascending steps of the core pillar, and the protruding side portions of the electrically conductive springs are connected to where the steps of the core pillar and the base cover engage with one another respectively.

The upper surface of the cover of the present invention can be provided with a face cover having at least one opening; a mounting plate having at least one opening is disposed between the cover and the electrode bracket; and the electricity supply members are wire connecting plates which are connected to one side of the electrically conductive members.

The bottom end of the socket core of the present invention is provided with a shifting wheel; the base plate is provided with a fixation mechanism; and the fixation mechanism comprises one or more fixation members which engages with the shifting wheel and a release spring which abuts against the fixation member.

The socket core of the present invention can be molded as an integrated assembly by injection molding; and the electrically conductive springs can be molded inside the socket core directly.

The present invention can also comprise a housing enclosing the assembly formed by the cover, the base plate and the electrode bracket; the top surface of the housing has at least one opening and its bottom surface is open; the base plate and the opening surface of the housing engage and are tightly assembled together; and the electricity supply members are standard socket pins electrically connecting to the electrically conductive members and protruding from the base plate.

A ratchet wheel is disposed at the bottom end of the socket core and a ratchet pawl which engages with the ratchet wheel is disposed in the base plate.

As an alternative, the electrically conductive members can be electrically conductive contacts which are disposed on the inner circumferential surfaces of the openings of the electrode bracket.

The protruding side portions of the electrically conductive springs of the socket core can alternatively form a ring which surrounds the outer circumferential surface of the socket core and can contact the electrically conductive contacts in a sliding manner.

The apertures of the socket core of the present invention can be pillar-shaped of identical shape or combinations of different shapes.

A socket core that is rotatable in one full circle is disposed in the electrode bracket of the present invention. It maintains contacts with the electrically conductive members of the electrode bracket in a sliding manner by means of the protruded portions of the electrically conductive springs.

The electrically conductive members connect through the electricity supply members to conducting wires of each phase of outside electricity source respectively. That is, when the socket core rotates 360° in relation to the fixed electrode bracket and electrically conductive members, the protruding side portions of the electrically conductive springs in the apertures remain to be electrically connected to the electrically conductive members of the electrode bracket. For the purpose of ensuring that the socket core rotates stably, the engagement of the shifting wheel at the bottom end of the socket core and the fixation mechanism can effect stable and progressive rotation of the socket core.

When a plug cannot be inserted because of insufficient space, the space limitation can be overcome by rotating and changing the angle of the socket core appropriately and the plug can then be successfully inserted into the socket. The socket core of the present invention can be used in a single socket. It can also be used in row sockets, and the insufficient space for adjacent plugs in row sockets can be overcome by rotating in the same manner. By changing the structure and shape of the electricity supply members which are connected to an outside electricity source, for example by having the electricity supply members in the shape of pins of a standard plug, the present invention possesses the additional function of a switching socket. That is, the socket of the present invention can be plugged into an existing available socket, thereby attaining the object of increasing electricity distribution. In addition, according to the number of phases of different electricity sources, such as 2-phase electricity source, 3-phase electricity source, 3-phase 4-wire electricit y source and so on, the electrode bracket can be provided with a corresponding number of electrically conductive members and the socket core can be provided with a corresponding number of apertures, thereby fulfilling different needs. The present invention is of simple construction and can be easily manufactured at low costs. Wear due to friction can also be greatly reduced, thereby increasing its life span and safety performance. It has bright promising market prospects.

BRIEF DESCRIPTION OF THE DRAWINGS

The present invention is further described in detail by means of embodiments with accompanying drawings as follows.

DETAILED DESCRIPTION OF THE INVENTION

Figure 1:
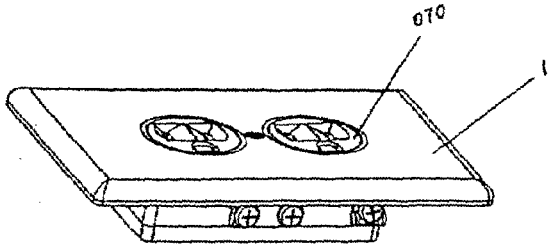
FIG. 1 shows the perspective view of a preferred embodiment of the present invention.
Figure 2:
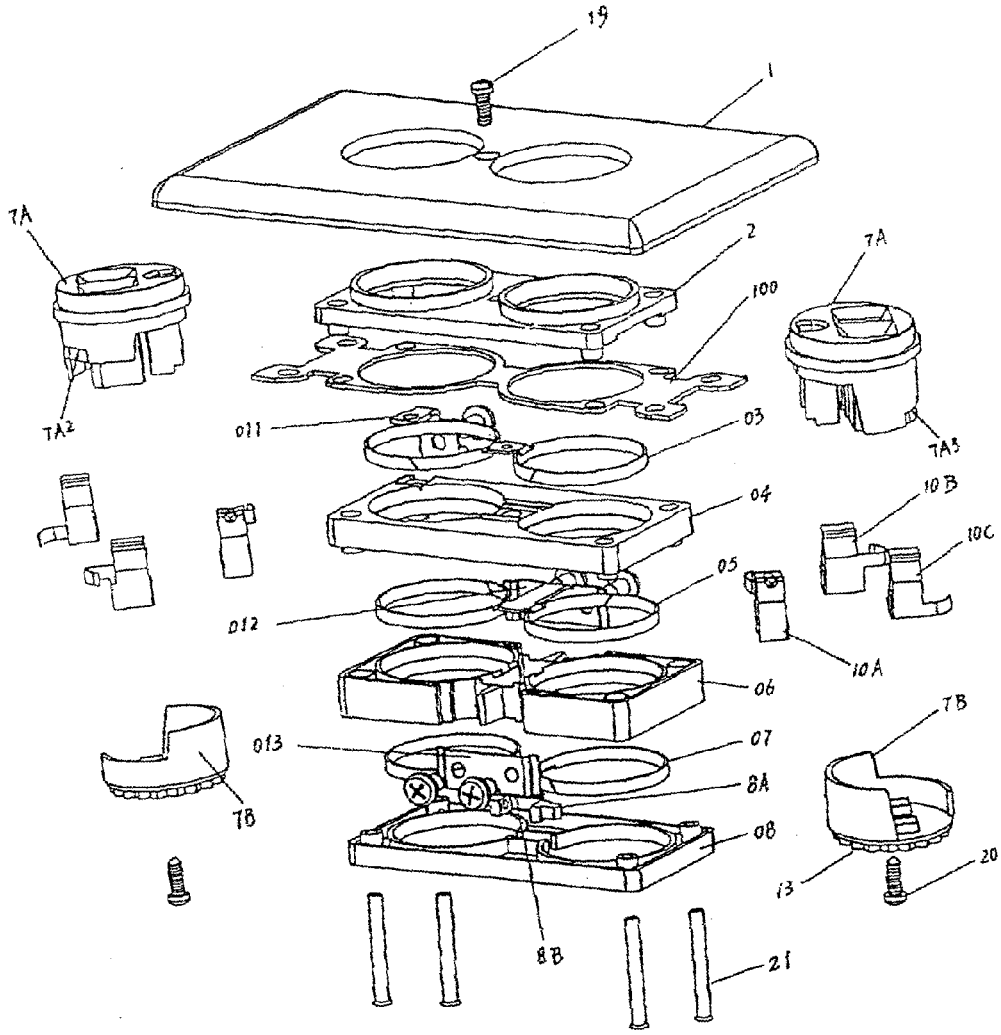
FIG. 2 shows the exploded view of the preferred embodiment of the present invention.
Figure 3:
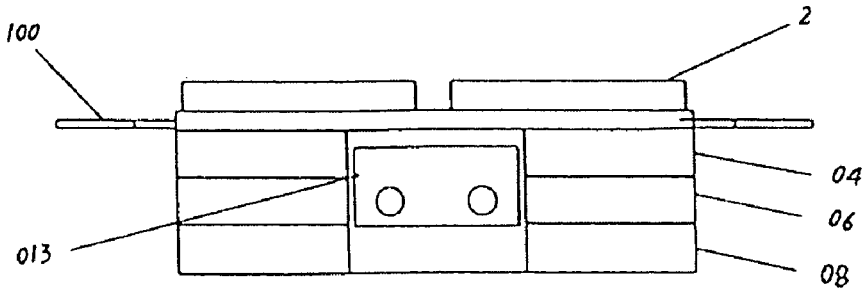
FIG. 3 shows the front elevational view of the preferred embodiment of the present invention with the face cover removed.
Figure 4:
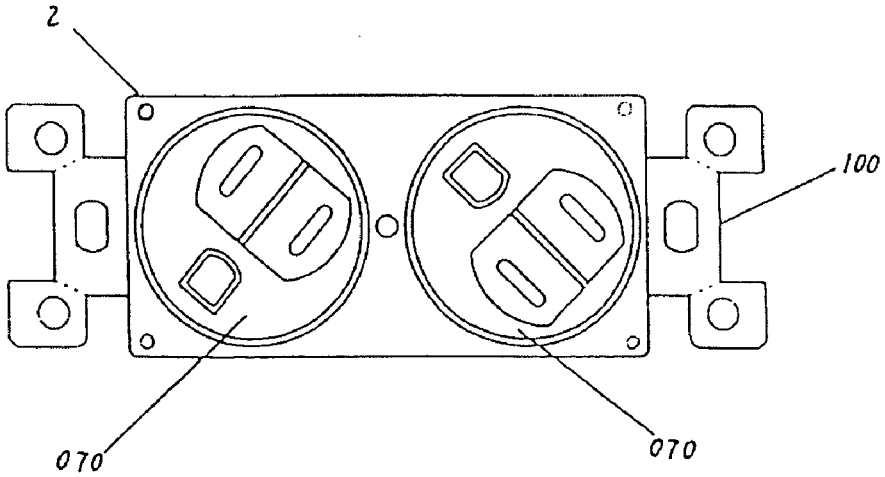
FIG. 4 shows the top plan view of FIG. 3.
Figure 5:
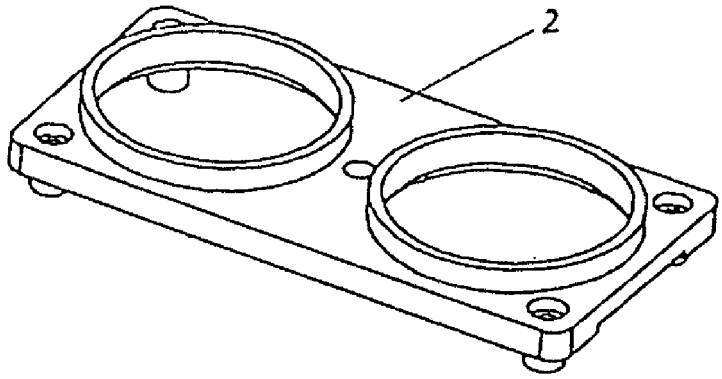
FIG. 5 shows the perspective view of the cover in FIG. 2.
Figure 6:
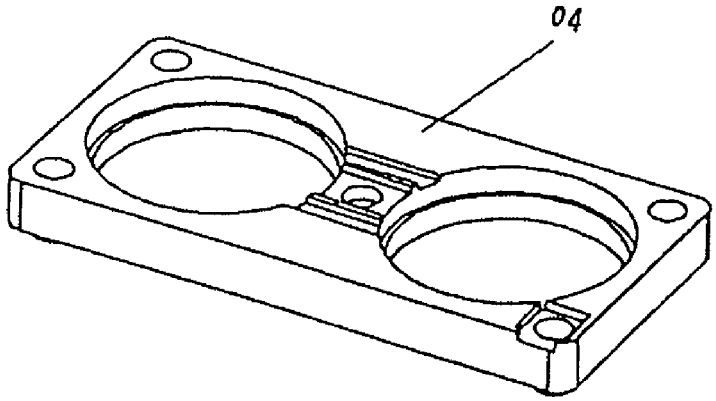
FIG. 6 shows the perspective view of the upper electrode bracket in FIG. 2.
Figure 7:
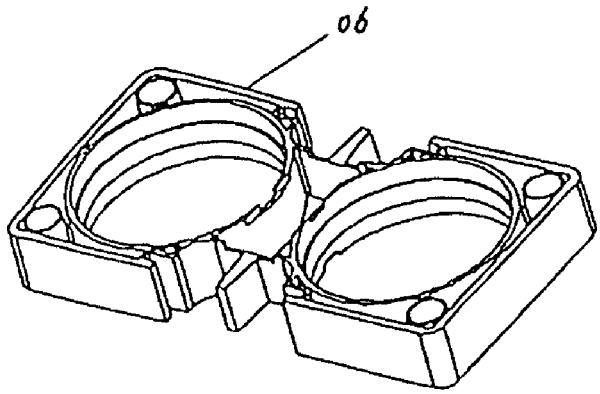
FIG. 7 shows the perspective view of the middle electrode bracket in FIG. 2.
Figure 8:
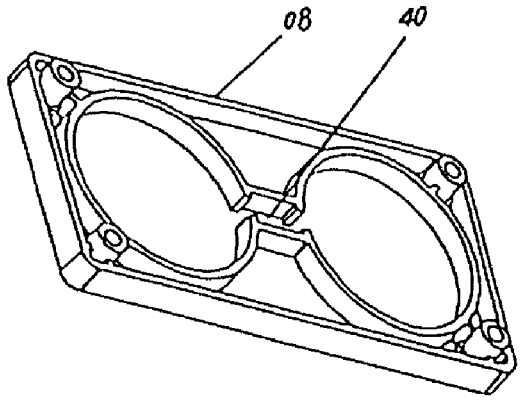
FIG. 8 shows the perspective view of the base plate in FIG. 2.
Figure 9:
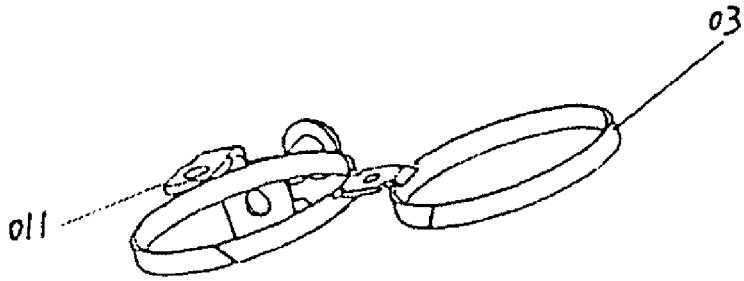
FIG. 9 shows the perspective view of the first layer electrically conductive ring in FIG. 2.
Figure 10:
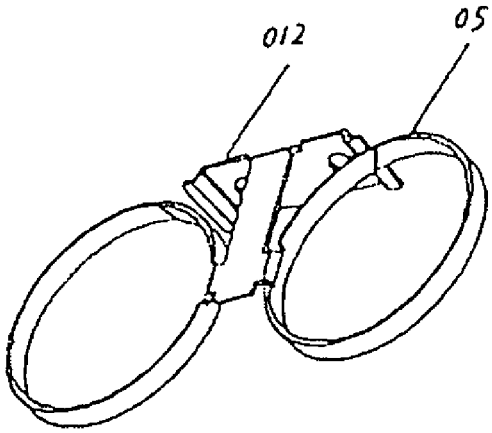
FIG. 10 shows the perspective view of the second layer electrically conductive ring in FIG. 2.
Figure 11:
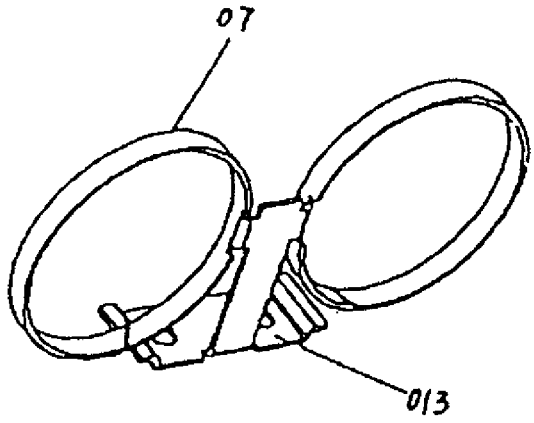
FIG. 11 shows the perspective view of the third layer electrically conductive ring in FIG. 2.

FIGS. 1 and 2 show the basic construction of a preferred embodiment of the present invention. The socket with rotatable socket cores comprises a plastic face cover 1 with two openings. The inner surface of the face cover 1 is connected in sequence to a plastic cover 2 with two openings (as shown in FIG. 5), a steel mounting plate 100 with two openings (as shown in FIGS. 3 and 4), electrode bracket which is formed by an upper and a middle plastic electrode brackets 04, 06 each with two openings stacked in layers to form an integrated assembly, and a base plate 08 with two hollow openings, that is, the bottom of which is sealed (as shown in FIGS. 6 to 8). The electrode bracket can be integrally formed or assembled into one piece or is divided into layers and stacked together to form one piece for satisfying different technical needs. The openings of the face cover 1, the cover 2, the mounting plate 100, the electrode bracket 04, 06 and the base plate 08 correspond to one another for assembling along the same axis. In this embodiment, the electrically conductive members disposed on the inner circumferential surfaces of the openings of the electrode bracket are electrically conductive rings 03, 05, 07. A copper electrically conductive ring 03 is inserted into the inner circumferential surface of each opening of the upper electrode bracket 04 (forming the first layer electrically conductive ring). A copper electrically conductive ring 05, 07 is inserted into the top end and the bottom end respectively of each opening of the middle electrode bracket 06 (forming the second layer electrically conductive ring and the third layer electrically conductive ring respectively). The electrically conductive rings of the same layer are electrically connected. On one side of the electrically conductive rings of each layer, there are copper wire connecting plates 011, 012, 013 which are connected to an outside electricity source (as shown in FIGS. 9 to 11). Two plastic socket cores 070 pass through the openings of the face cover 1, the cover 2 and the mounting plate 100 and are inserted into the openings of the electrode bracket 04, 06 movably, thereby enabling the socket cores 070 to rotate in one full circle in relation to the corresponding electrically conductive rings 03, 05, 07 (as shown in FIG. 15).

Figure 13:
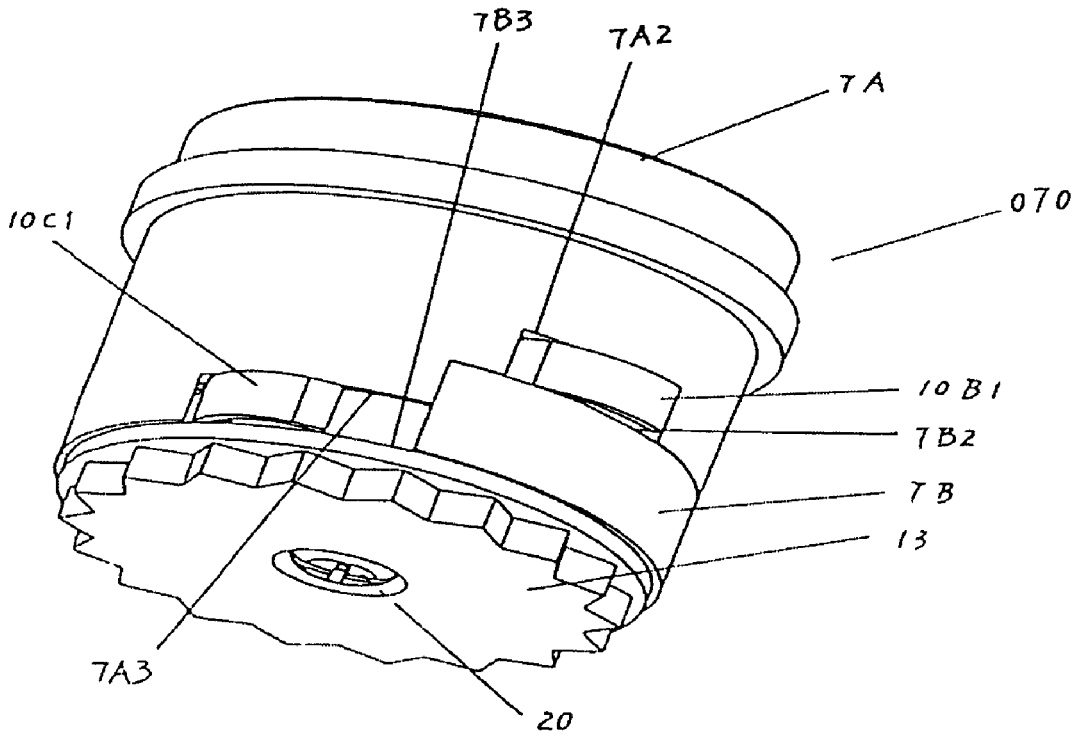
FIG. 13 shows the perspective view of the socket core of the preferred embodiment.
Figure 14:
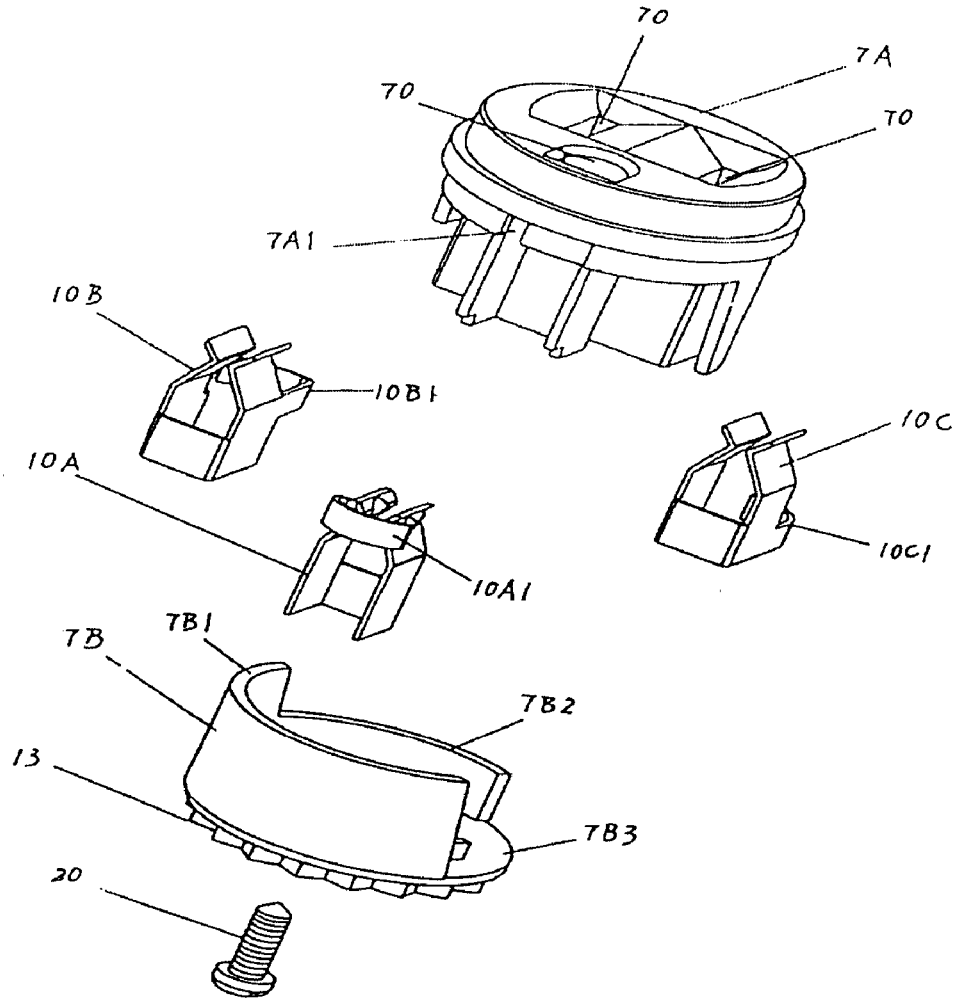
FIG. 14 shows the exploded view of the socket core of the preferred embodiment.

As illustrated in FIGS. 13 and 14, the socket core 070 comprises a core pillar 7A with three ascending steps 7A1, 7A2, 7A3 on its outer circumferential surface and a base cover 7B with three descending steps 7B1, 7B2, 7B3 on its outer circumference which engage with the ascending steps of the core pillar 7A. The core pillar 7A and the base cover 7B are connected together by a screw 20 to form a cylindrical pillar. The socket core 070 has three apertures 70 and each aperture 70 is provided with a copper electrically conductive spring 1A, 10B, 10C. The side portions 10A1, 10B1, 10C1 of the three electrically conductive springs diverge in the upper, middle and lower directions respectively and protrude outwards from the outer circumferential surface of the socket core 070 and are connected to where the corresponding steps of the core pillar 7A and the base cover 7B engage with one another. As illustrated in FIG. 15, the protruding side portions 10A1, 10B1, 10C1 of the electrically conductive springs come into contact with the inner circumferential surfaces of the corresponding electrically conductive rings 03, 05, 07 inside the electrode bracket 04, 06. That is, when the socket core 70 rotates in one full circle, the electrically conductive springs 10A, 10B, 10C remain to be electrically connected to the electrically conductive rings 03, 05, 07. The plastic face cover 1 can be made into different sizes and structures according to needs. The plastic face cover 1 may be removed while in use, as illustrated in FIGS. 3 and 4.

Figure 15:
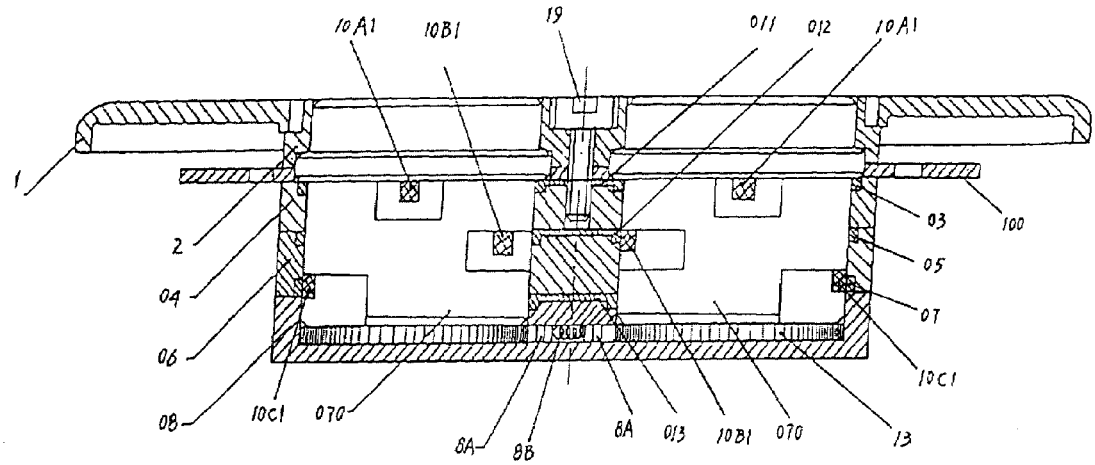
FIG. 15 shows the cross-sectional view of the second embodiment of the present invention.
Figure 16:
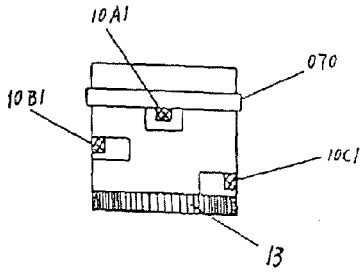
FIG. 16 shows the front elevational view of the socket core of the second embodiment.
Figure 17:
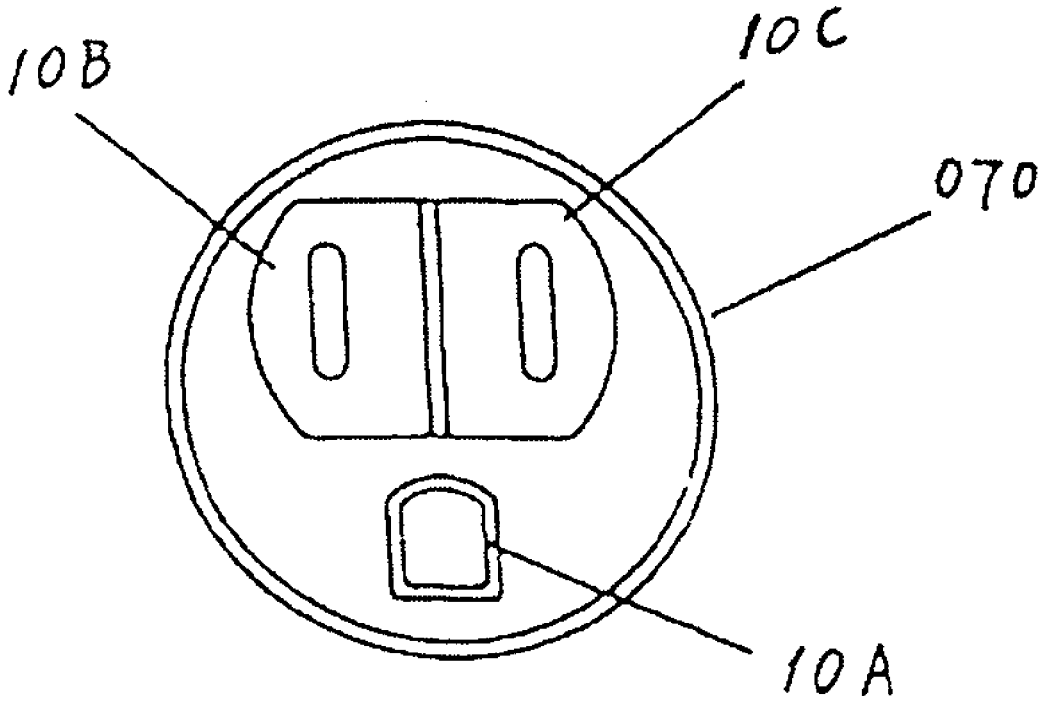
FIG. 17 shows the top plan view of FIG. 16.

In the second embodiment of the present invention, as illustrated in FIGS. 15 to 17, the socket core 070 can be molded as an integrated assembly by injection molding and the electrically conductive springs 10A, 10B, 10C can be molded inside the socket core 070 directly provided that the side portions 10A1, 10B1, 10C1 of the electrically conductive springs pass through and protrude outwards from the socket core 070.

Figure 23:
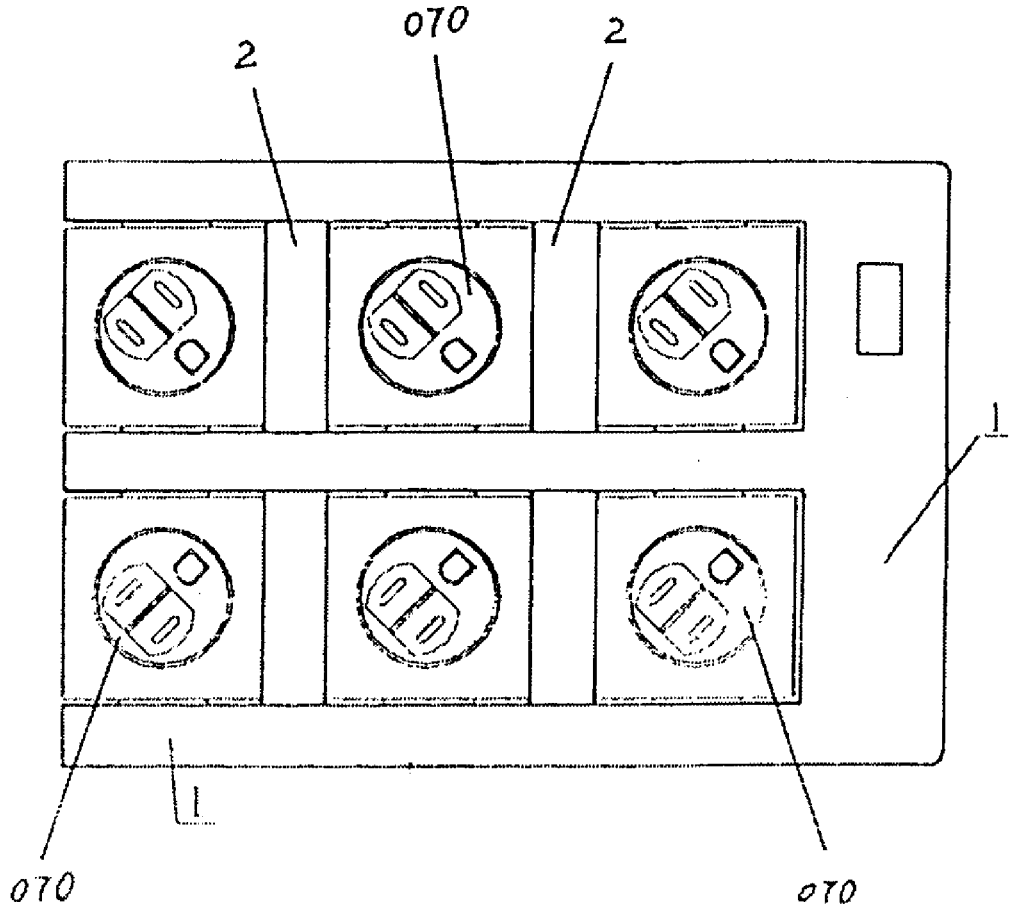
FIG. 23 shows the front elevational view of the second embodiment in row sockets of the present invention.

The present invention can be disposed with a plurality of the socket cores 070 according to various needs by adapting correspondingly the number of openings of the electrode bracket and the number of electrically conductive rings. As illustrated in FIG. 23, the embodiment is row sockets disposed with six of the socket cores, thereby forming multiple sockets (serving as a junction unit).

The number of apertures 70 of the socket core 070 should be identical to the number of layers of the electrically conductive rings in the electrode bracket 04, 06. That is, if there are three apertures 70 in the socket core, there should be three layers of the electrically conductive rings 03, 05, 07. According to use in different circumstances, the number of layers of electrically conductive rings and the number of apertures of the socket core may vary. For example, domestic sockets can be disposed with the socket cores with two apertures and two layers of electrically conductive rings (2-phase electricity source) or the socket cores with three apertures and three layers of electrically conductive rings (3-phase electricity source). As for Industrial sockets, they can be disposed with the socket cores with three apertures and three layers of electrically conductive rings or the socket cores with four apertures and four layers of electrically conductive rings (3-phase 4-wire electricity source) and so on. The shapes of the apertures 70 of the socket core 070 can be identical such as cylindrical, flat and so on, or it can be combinations of different shapes as illustrated in FIG. 4. The electrically conductive rings 03, 05, 07 of the electrode bracket 04, 06 should be in contact in a sliding manner with the protruding side portions 10A1, 10B1, 10C1 of the electrically conductive springs 10A, 10B, 10C of the socket core. That is, one electrically conductive spring can only be electrically connected to electrically conductive rings of one layer but not electrically conductive rings of other layers, which is illustrated in FIGS. 15 to 17. This construction ensures that electrically conductive rings of each layer can independently output a single phase current and guarantees safety.

Figure 12:
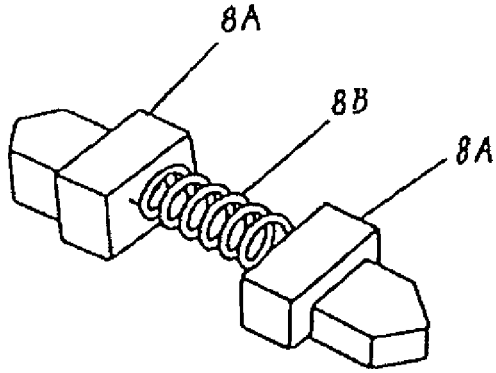
FIG. 12 shows the perspective view of the fixation mechanism in FIG. 2.

As illustrated in FIG. 8, the bottom of the base plate 08 is sealed. A groove 40 is disposed between the two openings and a fixation mechanism is disposed in the groove. As illustrated in FIG. 12, the fixation mechanism comprises fixation members 8A and a release spring 8B which abuts against the fixation members. As illustrated in FIG. 13, the bottom end of the socket core 070 is connected to a shifting wheel 13 which has teeth on its outer circumference which engage with the sharp projecting member of the fixation members 8A. The shifting wheel can be molded as an integrated assembly with the socket core (or the base cover 7B of the socket core) by injection molding or it can be manufactured separately and connected by a screw 20 or by adhesive. As illustrated in FIG. 15, after assembling the sharp projecting member of the fixation members 8A can be inserted into the notch of the shifting wheel 13. When the socket core 070 is rotated, the fixation members 8A move to and fro under the action of the release spring 8B and remain to be in contact with the shifting wheel 13 all the time. By means of the engagement of the fixation mechanism and the shifting wheel 13, the socket core 070 can exhibit two-way progressive rotation, and rotation of the socket core is maintained to be stable.

In another embodiment, the shifting wheel 13 is a ratchet wheel. The fixation mechanism is a ratchet pawl (not shown) which engages with the ratchet wheel. By means of the engagement of the ratchet wheel and the ratchet paw, the socket core 070 can also exhibit stable and progressive rotations.

As illustrated in FIG. 2, when the socket is assembled, the two layers of electrode bracket 04, 06 with the electrically conductive rings 03, 05, 07 mounted thereon are stacked together. The mounting plate 100 and the cover 2 are then installed in place. The openings of every layer align axially. The four corners are then fixed by rivets 21. Connection can also be done by means of screws or adhesive. The socket core 070 which is pre-installed with the electrically conductive springs 10A, 10B, 10C (as shown in FIG. 13 to 14 or FIG. 16 to 17) are then movably inserted into the openings of the electrode bracket, thereby enabling the shifting wheel 13 to engage with the fixation members 8A which are pre-installed in the groove 40 of the base plate 08. The face cover 1 is then placed on the top and fixed onto the other parts by a screw 19, thereby completing the assembling of the socket. Where there is insufficient space to insert a plug, by rotating the socket core of the socket appropriately, this can effectively solve the difficulty in inserting the plug.

Figure 18:
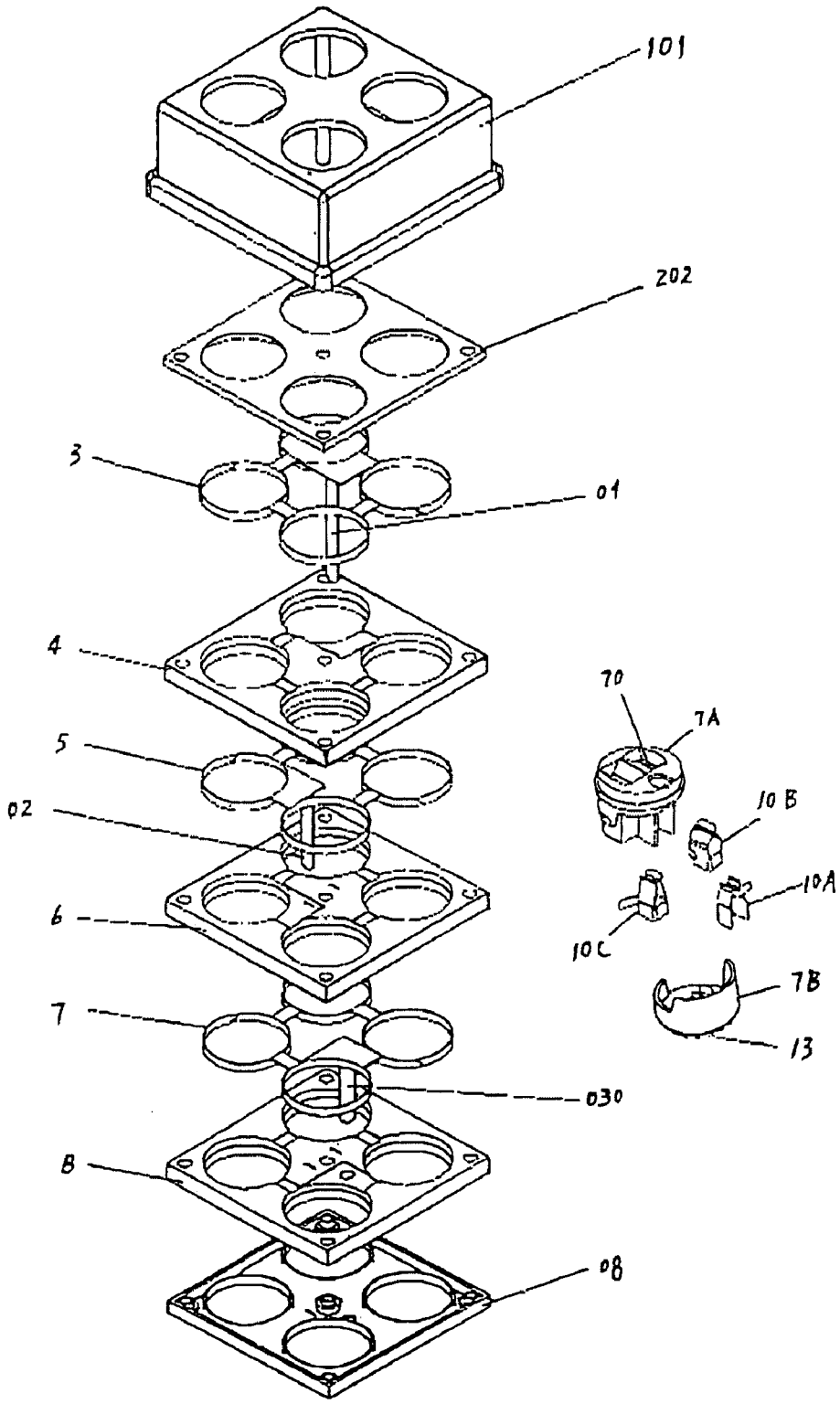
FIG. 18 shows the exploded diagram of the third embodiment of the present invention.
Figure 19:
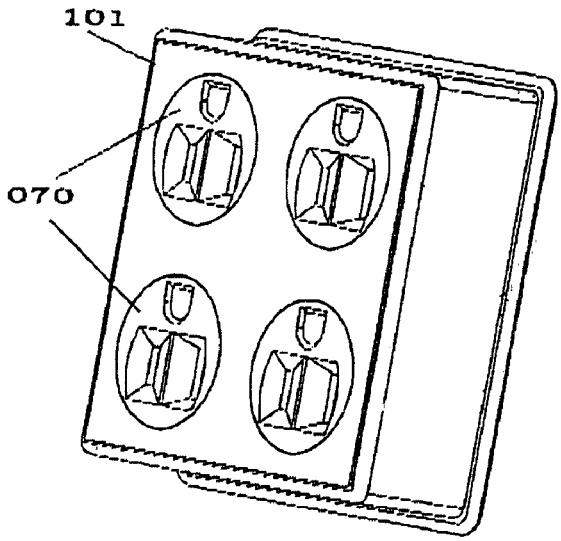
FIG. 19 shows the perspective view from the top surface of the third embodiment of the present invention.
Figure 20:
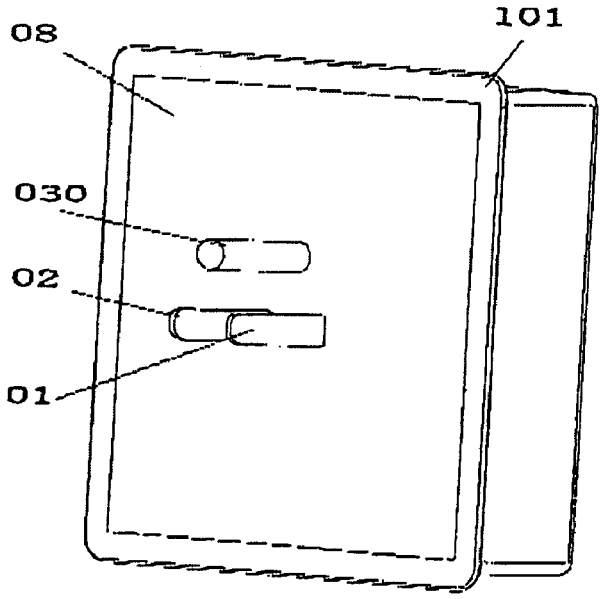
FIG. 20 shows the perspective view from the bottom surface of the third embodiment of the present invention.
Figure 21:
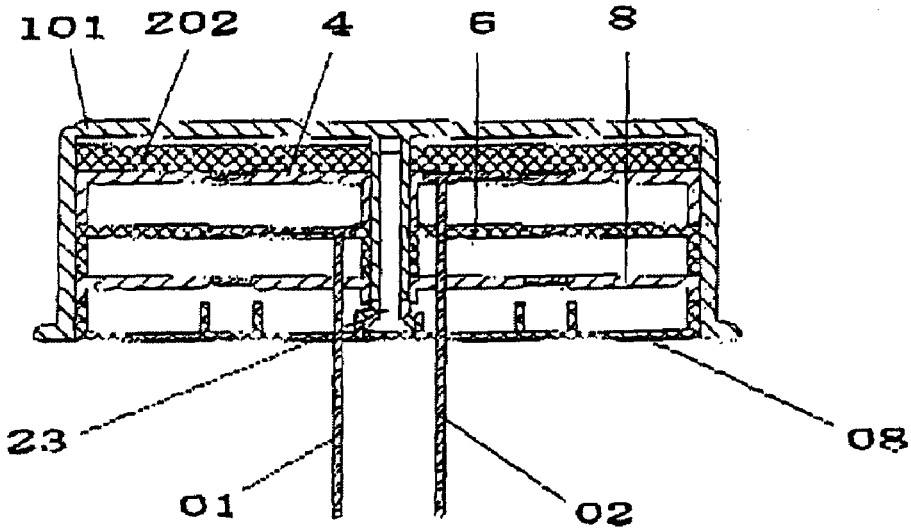
FIG. 21 shows the cross-sectional view, taken along the line A—A of FIG. 20.
Figure 22:
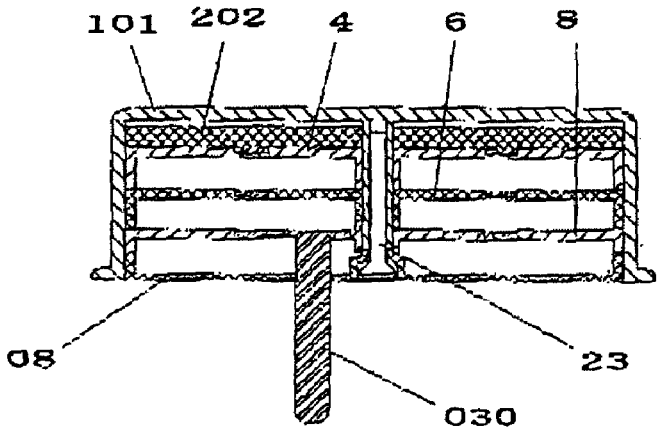
FIG. 22 shows the cross-sectional view, taken along the line B—B of FIG. 20.

FIGS. 18 to 20 illustrate the basic construction of the third embodiment of the present invention. The basic construction of this embodiment is similar to that of the first embodiment of the present invention. The basic construction of this embodiment comprises three layers of insulated electrode bracket 4, 6, 8 with four openings, electrically conductive rings 3, 5, 7 which are inserted into the inner circumferential surfaces of the openings of the electrode bracket of each layer, a cover 202 on top of the upper electrode bracket 4 and socket cores 070 which are movably inserted into the openings of the electrode bracket and are rotatable in one full circle. The structure of the socket cores 070 and the relative positioning of the socket cores and the electrically conductive rings are the same as those in the first embodiment of the present invention. The difference is that this embodiment is disposed with four socket cores 070 (a plurality of socket core can be disposed according to different needs). A housing 101 is disposed, enclosing the basic construction. One end of the housing has four openings and the other end has an opening on its surface. The opening end of the housing 101 is provided with a base plate 08 with four hollow openings which encloses the basic construction. The main feature of this embodiment is that the electricity supply members are vertically connected to each layer of the electrically conductive rings 3, 5, 7 and protrude out from the standard socket pins 01, 02, 030 of the base plate 08. That is, the electrically conductive rings of each layer connect correspondingly to one standard socket pin, as illustrated in FIGS. 21 and 22. The shapes of the socket pins can be identical such as cylindrical, flat and so on, or it can be combinations of different shapes as illustrated in FIG. 20, so that socket pins of different technical standards can be made. The electrically conductive rings are connected to an outside electricity source by means of the socket pins. Apart from having the function of the rotatable socket cores, this embodiment possesses an additional function of switching sockets. When a number of plugs are to be inserted, this can be done by simply plugging the socket pins of this embodiment into an existing available single socket.

In the third embodiment, a ratchet wheel 13 is disposed at the bottom of the socket core 070 and a ratchet pawl (not shown) which engages with the ratchet wheel 13 is disposed in the centre of the inner surface of the base plate 08. After assembling, the sharp projecting member of the ratchet pawl inserts into the notch of the ratchet wheel 13. When the socket core 070 rotates, the socket core 070 can exhibit stable and progressive rotation by means of the engagement of the ratchet pawl and the ratchet wheel 13.

As illustrated in FIG. 18, when the socket of the third embodiment is assembled, the electrode bracket 4, 6, 8 which are pre-mounted with the electrically conductive rings 3, 5, 7, are stacked together. The cover 202 is then placed on top of the upper electrode bracket and fixed by rivets at its four corners. Connection can also be done by means of screws or adhesive. The socket core 070 which is pre-installed with the electrically conductive springs 10A, 10B, 10C are then movably inserted into the openings of the electrode bracket, thereby completing the assembling of the basic construction. The housing 1 and the base plate 08 are then installed, so that the standard socket pins 01, 02, 030 which are connected to the electrical conductive rings 3, 5, 7 pass through and protrude out from the base plate 08 and that the ratchet wheel 13 engages with the ratchet pawl (not shown) which is pre-mounted on the inner surface of the base plate 08. The parts are fixed together (as illustrated in FIGS. 21 to 22) by a screw 23, thereby completing the assembling of the socket. When a number of plugs are to be inserted, the present invention can be plugged into an existing socket. Where there is insufficient space to insert a plug, by rotating the socket core of the socket appropriately, this can effectively solve the difficulty in inserting the plug.

In other embodiments of the present invention, the electrically conductive members 03, 05, 07 which are disposed on the inner circumferential surfaces of the openings of the insulated electrode bracket can be configured into a contact structure. The protruding side portions 10A1, 10B1, 10C1 of the electrically conductive springs of the socket core corresponding to the contacts can be configured into a ring structure along the outer circumferential surface of the socket core. When the socket core 070 rotates in one full circle, the electrically conductive members and the electrically conductive springs remain to be in electrical contact with one another (not shown).

Apart from the constructions of the above embodiments, the construction of the electrically conductive members disposed on the inner circumferential surfaces of the openings of the insulated electrode bracket and the construction of the electrically conductive springs which engage with the corresponding electrically conductive members in a complete circle can be in various forms. Any of those forms in which the electrically conductive springs of the socket core remain to be in electrical contact with the conductive members When the socket core rotates in one full circle fall within the scope of the claims of the present invention.

What is claimed is:

1. A socket with rotatable socket core comprising:

a cover;

a base plate;

an electrode bracket disposed in between the cover and the base plate, wherein the cover, the electrode bracket and the base plate each has at least one opening which corresponds to each other longitudinally and concentrically, and the inner circumferential surfaces of the concentric openings of the electrode bracket are provided with electrically conductive members positioned separately and longitudinally, and the electrically conductive members are connected to electricity supply members which can be electrically connected to an outside electricity source;

at least one socket core that is rotatable in one full circle which is disposed inside the concentric openings of the base, the electrode bracket and the plate, wherein a plurality of apertures is disposed longitudinally inside the socket core, and a plurality of electrically conductive springs is provided inside each of the apertures, and a side portion of each of the electrically conductive springs diverges longitudinally and protrudes outwards from the outer circumferential surface of the socket core, and maintains contacts with one of the electrically conductive members correspondingly when the socket core is rotating in 360°.

2. The socket with rotatable socket core as in claim 1, wherein the electrode bracket is divided into layers and stacked together to form one piece.

3. The socket with rotatable socket core as in claim 1, wherein the electrically conductive members are electrically conductive rings disposed on the inner surfaces of the openings of the electrode bracket.

4. The socket with rotatable socket core as in claim 3, wherein the socket core comprises a core pillar with ascending steps on its outer circumferential surface, a base cover with descending steps on its outer circumference which engage with the ascending steps of the core pillar, and the protruding side portions of the electrically conductive springs are connected to where the steps of the core pillar and the base cover engage with one another respectively.

5. The socket with rotatable socket core as in claim 1, wherein the electrically conductive members are electrically conductive contacts which are disposed on the inner circumferential surfaces of the openings of the electrode bracket, and the protruding side portions of the electrically conductive soririgs of the socket core form a ring which surrounds the outer circumferential surface of the socket core and contacts the electrically conductive contacts in a sliding manner.

6. The socket with rotatable socket core as in claim 1, wherein the bottom end of the socket core is provided with a shifting wheel; the base plate is provided with a fixation mechanism; and the fixation mechanism comprises one or more fixation members which engages with the shifting wheel and a release spring which abuts against the fixation member.

7. The socket with rotatable socket core as in any of claims 1 to 5, wherein it also comprises a housing enclosing the assembly formed by the cover, the base plate and the electrode bracket; the top surface of the housing has at least one opening and its bottom surface is open; the base plate and the opening surface of the housing engage and are tightly assembled together; and the electricity supply members are standard socket pins electrically connecting to the electrically conductive members and protruding from the base plate.

8. The socket with rotatable socket core as in claim 1, wherein a ratchet wheel is disposed at the bottom end of the socket core and a ratchet pawl which engages with the ratchet wheel is disposed in the base plate.

* * * * *